US005655199A

United States Patent [19]

Yamashita et al.

[11] Patent Number: 5,655,199

[45] Date of Patent: Aug. 5, 1997

[54] INTERMEDIATE TRANSFER TYPE IMAGE FORMING APPARATUS AND AN INTERMEDIATE TRANSFER MEDIUM THEREFOR

[75] Inventors: Masahide Yamashita, Numazu; Yasuo Hirano, Mishima; Jun Aoto, Fuji; Mitsuru Seto, Yamakita-machi; Shigeru Fukuda, Kawasaki, all of Japan

[73] Assignee: Ricoh Company, Ltd., Tokyo, Japan

[21] Appl. No.: 618,818

[22] Filed: Mar. 20, 1996

[30] Foreign Application Priority Data

Mar. 22, 1995 [JP] Japan ..... 7-062899
Mar. 1, 1996 [JP] Japan ..... 8-044999

[51] Int. Cl.[6] ..... G03G 15/16

[52] U.S. Cl. ..... 399/302; 399/308; 430/126

[58] Field of Search ..... 399/302, 308; 430/126

[56] References Cited

U.S. PATENT DOCUMENTS 4,984,026 1/1991 Nishise et al. .
5,099,286 3/1992 Nishise et al. .
5,182,598 1/1993 Hara et al. .
5,285,244 2/1994 Bujese .
5,409,557 4/1995 Mammino et al. ..... 430/126
5,428,429 6/1995 Fletcher .
5,510,886 4/1996 Sugimoto et al. .

FOREIGN PATENT DOCUMENTS 63-311263 12/1988 Japan .
3-69166 7/1991 Japan .
3-192282 8/1991 Japan .
6-149079 5/1994 Japan .

OTHER PUBLICATIONS

English Abstract of Japanese Document JP 07140802, Published Jun. 2, 1995 From "Patent Abstracts of Japan" (CD–ROM) Unexamined Applications, vol. 95, No. 6, Database Japio.

*Primary Examiner*—R. L. Moses
*Attorney, Agent, or Firm*—Oblon, Spivak, McClelland, Maier & Neustadt, P.C.

[57] ABSTRACT

An intermediate transfer type image forming apparatus for sequentially performing primary and secondary image transfer with the intermediary of an intermediate transfer medium implemented as, e.g., a belt, and the intermediate transfer member are disclosed. The image transfer medium has a lower surface resistivity on its rear than on its front or image carrying surface.

8 Claims, 1 Drawing Sheet

INTERMEDIATE TRANSFER TYPE IMAGE FORMING APPARATUS AND AN INTERMEDIATE TRANSFER MEDIUM THEREFOR

BACKGROUND OF THE INVENTION

The present invention relates to a printer, facsimile apparatus or similar electrophotographic image forming apparatus and, more particularly, to an intermediate transfer type image forming apparatus which sequentially performs primary and secondary image transfer with the intermediary of an intermediate transfer medium implemented as, e.g., a belt, and the intermediate transfer member.

Today, electrophotographic image forming apparatuses having full-color copying and printing capabilities are extensively used. For the transfer of a full-color image to a recording medium, a so-called transfer drum type system and an intermediate transfer body, double transfer type system or simply intermediate transfer type system are available. The transfer drum type system sequentially forms a yellow (Y) image, magenta (M) image, cyan (C) image and black (BK) image on a photoconductive element or similar image carrier, and sequentially transfers them one above the other to a recording medium fixed on a transfer drum. The intermediate transfer type system sequentially transfers the Y, M, C and BK images from the image carrier to an intermediate transfer medium one above the other, and then collectively transfers the resulting full-color toner image to a recording medium. The intermediate transfer type system is advantageous over the transfer drum type system because it is paper-free and has a full-face copying ability.

However, the problem with the intermediate transfer type system is that toner is scattered on the intermediate transfer medium at the time of primary transfer. Specifically, when the toner image is transferred from the image carrier to the medium, it fails to reach an expected position on the medium and is scattered therearound. The resulting image is blurred. Particularly, such an image lacks sharpness when it comes to thin lines.

Some different approaches have heretofore been proposed to improve image quality in relation to the intermediate transfer type system, as follows.

(1) After toner having a high resistance has been non-electrostatically transferred to the intermediate transfer medium, a recording sheet is pressed against the medium by a heat roller (see Japanese Patent Laid-Open Publication No. 63-34570).

(2) After conductive toner has been non-electrostatically transferred to the intermediate transfer medium, a sheet is pressed against the medium by a heat roller (see Japanese Patent Laid-Open Publication No. 63- 34571).

(3) Every time a toner image is transferred to the intermediate transfer medium, the charge thereof is dissipated by a separation charger (see Japanese Patent Laid-Open Publication No. 1-282571).

(4) A higher transfer potential is assigned to the last transfer step than to the immediately preceding transfer step, and a preselected voltage is applied to the medium during the interval between consecutive transfer steps (see Japanese Patent Laid-Open Publication No. 2-183276).

(5) Means is provided for dissipating the charge of the intermediate transfer medium at a stage preceding means for transferring a toner image from the medium to a sheet (see Japanese Patent Laid-Open Publication No. 4-147170).

Among the above prior art approaches, the approaches (1) and (2) need a recording sheet to be pressed by the heat roller and cannot take advantage of the paper-free feature available with the intermediate transfer type system. The approaches (3) through (5) each needs exclusive discharging or voltage applying meas and/or control means for controlling it. This not only complicates a machine control mechanism, but also obstructs the miniaturization of the machine.

SUMMARY OF THE INVENTION

It is therefore an object of the present invention to provide an intermediate transfer member capable of obviating the scattering of toner without resorting to any additional mechanism in the machine aspect.

It is another object of the present invention to provide an intermediate transfer medium capable of preventing the scattering of toner without causing defective images or similar adverse effects to occur.

It is another object of the present invention to provide an intermediate transfer type image forming apparatus capable of preventing the scattering of toner without causing defective images or similar adverse effects to occur.

In accordance with the present invention, in an intermediate transfer medium for an image forming apparatus which repeats with each of a plurality of toner images of particular colors a primary transfer for electrostatically transferring a toner image from an image carrier to the surface of the intermediate transfer medium, which is running at substantially the same speed as the image carrier, on the basis of a difference between the potential of the image carrier and a potential resulting from a voltage applied to between a transfer bias applying member and a grounding member located at the rear of the intermediate transfer medium, and then executes a secondary transfer for collectively transferring a composite image formed on the intermediate transfer medium by the primary transfer to a recording medium, the intermediate transfer medium has a lower surface resistivity on the rear thereof than on the front thereof constituting an image support surface.

Also, in accordance with the present invention, in an image forming apparatus which repeats with each of a plurality of toner images of particular colors a primary transfer for electrostatically transferring a toner image from an image carrier to the surface of an intermediate transfer medium, which is running at substantially the same speed as the image carrier, on the basis of a difference between the potential of said image carrier and a potential resulting from a voltage applied to between a transfer bias applying member and a grounding member located at the rear of the intermediate transfer medium, and then executes a secondary transfer for collectively transferring a composite image formed on the intermediate transfer medium by the primary transfer to a recording medium, the intermediate transfer medium has a lower surface resistance on the rear thereof than on the front thereof constituting an image support surface.

BRIEF DESCRIPTION OF THE DRAWING

The above and other objects, features and advantages of the present invention will become more apparent from the following detailed description taken with the accompanying drawing in which.

DESCRIPTION OF THE PREFERRED EMBODIMENT

Figure 1:
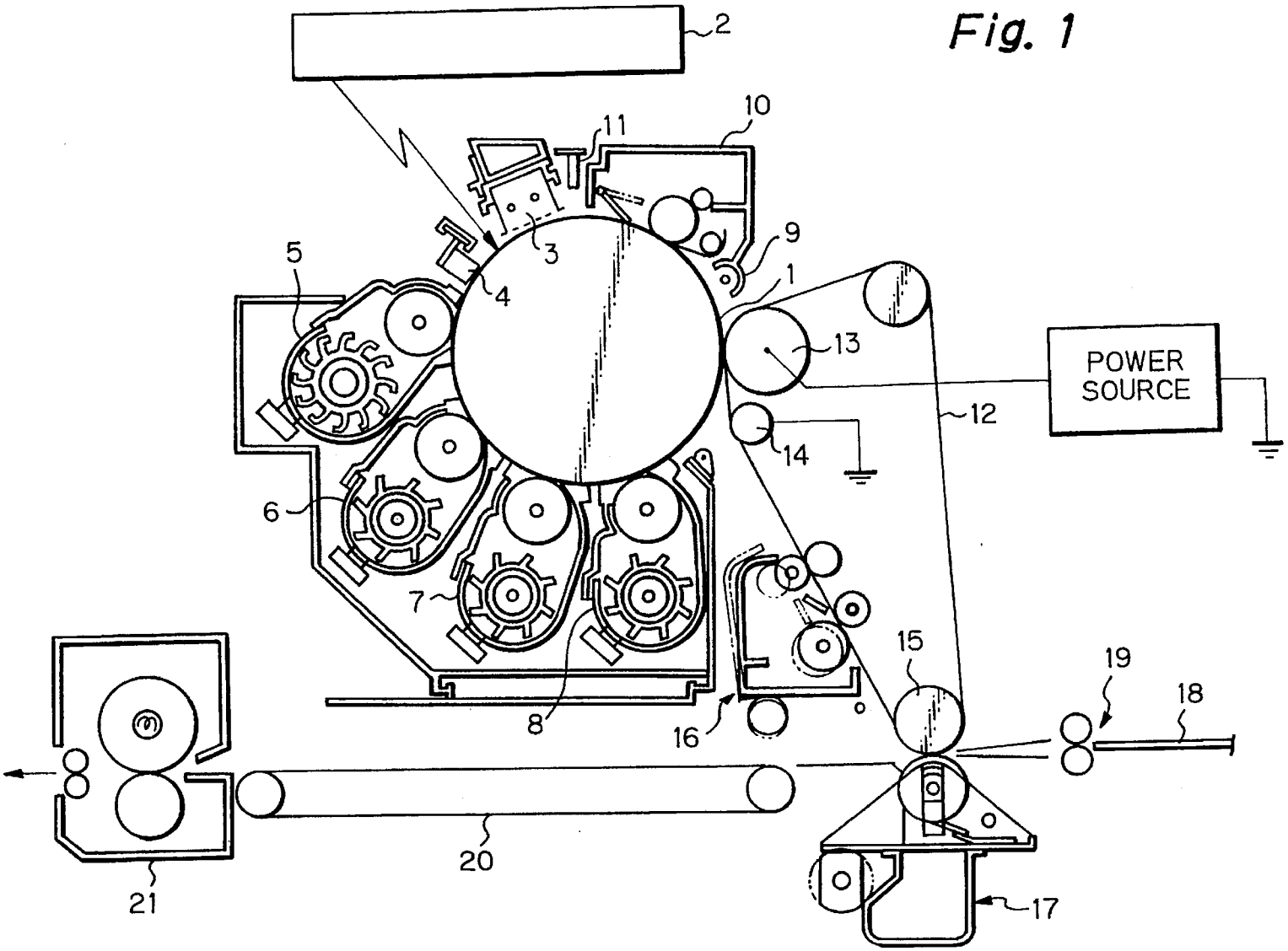
FIG. 1 is a fragmentary view of an intermediate transfer type image forming apparatus including an intermediate transfer body embodying the present invention.

The present invention will be described hereinafter with reference to the accompanying drawing. Terms "surface resistivity" which will repeatedly appear in the following description refer to, assuming a square having a unit area (e.g. 1 $cm^2$), an electric resistance to occur between the opposite sides of the square when a voltage is applied to between the opposite sides. While the unit of the surface resistivity is Ω, it will be denoted as Ω/∞ (∞ being the unit area) so as to be distinguished from a surface resistance.

Referring to FIG. 1, an image forming apparatus using an intermediate transfer medium embodying the present invention is shown. As shown, the apparatus has an image carrier implemented as a photoconductive drum 1. An optics unit 2 sequentially writes images on the drum 1 in accordance with image data each being representative of an image of particular color. A charger 3 uniformly charges the surface of the drum 1. The reference numeral 4 designates a potential sensor. Developing units 5–8 each develops a latent image of particular color electrostatically formed on the drum 1 by the optics unit 2. For example, the developing units 5–8 are a BK developing unit, C developing unit, M developing unit, and Y developing unit, respectively. The reference numeral 9 designates a precleaning discharger. A cleaning unit 10 removes toner and impurities left on the drum 1 after image transfer which wilt be described. A discharge lamp 11 dissipates charge also left on the drum 1 after image transfer. An intermediate transfer medium 12 is implemented as a seamless belt in the embodiment. Toner images sequentially formed on the drum 1 by the developing units 5–8 are sequentially transferred to the belt 12 one above the other. There are also shown in FIG. 1 a bias roller or transfer bias applying member 13 to which a bias for image transfer is applied, a ground roller or grounding member 14 connected to ground, a drive roller 15 for driving the belt 12, a belt cleaning unit 16 movable into and out of contact with the belt 12, an image transfer unit or secondary image transfer unit, 17 for transferring a color image from the belt 12 to a recording medium 18, a registration roller pair 19, a conveyor belt 20 for conveying the recording medium 18, and a fixing unit 21.

The present invention relates to the intermediate transfer type image forming apparatus and the intermediate transfer medium 12 therefor. In accordance with the present invention, the medium 12 obviates the scattering of toner thereon without resorting to any extra mechanism otherwise added to the apparatus. In this sense, the construction shown in FIG. 1 is only illustrative. For example, use may be made of an image carrier in the form of a photoconductive belt, a revolver accommodating a plurality of developing units therein, or a plurality of image carriers and a plurality of image forming means arranged in parallel and each being assigned to a particular color, so long as the apparatus has an intermediate transfer medium.

The belt 12 runs at substantially the same speed as the drum 1. A voltage is applied to between the bias roller 13 and the ground roller 14 contacting the rear or inner surface of the belt 12. Each toner image formed on the drum 1 by the charging, optical writing and developing steps is electrostatically transferred from the drum 1 to the outer surface or front of the belt 12 due to a difference between the potential derived from the voltage applied to between the rollers 13 and 14 and a potential deposited on the drum 1. The image transfer from the drum 1 to the belt 12 will be referred to as primary transfer hereinafter. The primary transfer is repeated with toner images of a plurality of colors, i.e., BK, C, M and Y in the embodiment. The resulting color image formed on the belt 12 is collectively transferred to the recording medium 18. This will be referred to as secondary transfer hereinafter. Subsequently, the color image is fixed on the recording medium 18 by the fixing unit 21 to complete a recording. The present invention is characterized in that the surface resistivity of the belt or intermediate transfer medium 12 is smaller on its rear than on its front or image support surface.

The above relation between the front and the rear of the belt 12 as to surface resistivity allows a current path to be surely formed between the bias roller 13 and the ground roller 14. In addition, such a relation reduces discharge from the front or image support surface of the belt 12 to the drum 1, or vice versa. Hence, the toner image formed on the drum 1 can be surely transferred to the belt 12 without being subjected to any extraneous electrostatic force other than the potential necessary for the transfer.

The image transfer from the drum 1 to the belt 12, i.e., primary transfer occurs due to the potential difference between the drum 1 and the belt 12, as stated earlier. Basically, the amount of image transfer is dependent on electrostatic attraction acting between the charge of the toner image and the charge induced in the belt 12 by the bias voltage. It follows that to achieve desirable image transfer, it is necessary to cause more than a certain amount of current to flow between the bias roller 13 and the ground roller 14.

For the above reason, the belt 12 should be provided with the following surface resistivity on its front:

(1) when the portion of the belt 12 including the rear contains at least inorganic conductive grain, a surface resistivity of preferably less than $10^{11}$ Ω/∞ inclusive, more preferably less than $10^{9}$ Ω/∞, inclusive; or (2) when the portion of the belt 12 including the rear contains at least an organic conducting agent, a surface resistivity of preferably less than $10^{9}$ Ω/∞ inclusive.

In the belt 12 in which the inorganic conductive grain is dispersed, the resistivity is dependent on voltage due to an energy gap occurring in the intergranular portion. The voltage dependency of the resistivity allows a higher resistivity range to be used than when the resistance is controlled by the organic conducting agent. While more than a certain amount of current is necessary for desirable image transfer, as mentioned earlier, excessive amounts of current are disadvantageous in respect of, e.g., energy efficiency, safety operation, and output power source load. Hence, the surface resistivity of the rear of the belt 12 should more preferably be higher than $10^{6}$ Ω/∞ inclusive.

On the other hand, when the belt 12 has a surface resistivity of $10^{8}$ Ω/∞ to $10^{13}$ Ω/∞ on its front, the following defective images can be obviated. When the resistivity is lower than $10^{8}$ Ω/∞, it is likely that the clear current path is not formed at the rear of the belt 12, failing to sufficiently reducing the scattering of toner. When the resistivity is higher than $10^{13}$ Ω/∞, it is likely that a residual image occurs because the front of the belt 12 itself is charged. Although this kind of residual image may be eliminated the belt 12 is discharged, this cannot be done unless an exclusive discharging mechanism is provided which would complicate the control and would increase the cost.

The intermediate transfer medium is implemented as the seamless belt 12, and the inner surface of the belt 12 constitutes the rear, as shown in FIG. 1. Such a configuration eliminates the need for a seam sensor and other extra devices, simplifies the belt drive mechanism, and saves space.

To make the most of the above advantages, the belt 12 should preferably be made up of two or more layers.

When the belt 12 has only a single layer, some different schemes are available for setting up the difference in surface resistivity between the front and the rear of the belt 12. For example, the composition ratio of the materials constituting the belt 12 is provided with a gradient in the front-and-rear direction. Alternatively, after the entire belt 12 has been molded by use of a single material, it is subjected to physical or chemical treatment in order to have a higher (or lower) resistance on the front (or the rear). However, these schemes are difficult to practice in respect of resistivity control, stable production, and cost.

Because the scattering of toner is obviated by controlling the surface resistivity of the rear of the belt 12, the above difficulty can be eliminated if the belt 12 is provided with a laminate structure.

For example, the belt 12 having a laminate structure may consist of a substrate having a relatively low surface resistance and produced by extrusion molding, and a surface layer formed on the front of the substrate by dipping, spraying, casting or similar painting technology. The surface layer would have a higher surface resistivity than the substrate if implemented as a single layer. Alternatively, the substrate may be provided with surface layers different in surface resistivity from each other on both sides thereof by the above technology such that the rear has a lower resistivity than the front. Another possible method consists in producing two or more different kinds of sheets (or belts) each having a particular surface resistivity, and laminating the sheets by adhesion, fusion or the like such that the resulting belt has a lower resistivity on the rear than on the front.

For the substrate of the belt 12, use may be made of a mixture of one or more thermoplastic resins and one or more organic or inorganic resistance control materials. The thermoplastic resins include polyethylene, polystyrene, polyvinyl chloride, polyester, nylon, polycarbonate, polyacrylonitrile, polyvinylidene fluoride, and ethylene tetrafluoroethylene copolymer. The resistance control materials include polyehtylene oxide, polyether amide, polyester ether amide, conductive polyaniline, alcane sulfonate metal salt, carbon, tin oxide, zinc oxide, and metal powder. Alternatively, a copolymer of thermoplastic resin and organic resistance control material may be used.

For the paint constituting the surface layer, the above resistance control material may be dissolved or dispersed in a solvent together with phenol resin, urea melamine resin, alkyd resin or similar thermosetting resin.

Preferred embodiments of the intermediate transfer medium in accordance with the present invention will be described hereinafter. In the following description, the term "parts" refers to parts by weight without exception, and all the substances except for solvents (dispersants) are measured in terms of solids. Also, surface resistivities to be described were measured by a surface resistivity gauge HIRESTA (trade name) available from Mitsubishi Yuka (Japan) for 10 seconds with a voltage of 500 V.

First, examples of the method of producing the substrate of the image transfer medium 12 will be described.

Substrate—Method 1

100 parts of polyvinylidene fluoride (PVdF) KF-850 (trade name) available from Kureha Kagaku Kogyo (Japan), 60 parts of conductive tin oxide T-1 (trade name) available from Mitsubishi Material (Japan), and 0.6 part of bis (dioctyl pyrophosphase) oxyacetate titanate KR138S available from Ajinomoto (Japan) were used as a base resin, conductive inorganic grain, and dispersant, respectively. The mixture of the above substances were kneaded and molded by a twin screw extruder to form a 150 μm thick hollow cylindrical substrate. The surface resistivity of the substrate was measured to be $2.5\times10^{9}$ Ω/∞ on both sides thereof.

Substrate—Method 2

The mixture of Substrate—Method 1 was also used except that the amount of conductive tin oxide was 50 parts. A 150 μm thick hollow cylindrical substrate was produced by the same procedure as in Substrate—Method 1. The surface resistivity of the substrate was measured to be $1.8\times10^{11}$ Ω/∞ on both sides thereof.

Substrate—Method 3

The base resin used in Substrate—Method 1 was mixed with 50 parts of organic conducting agent implemented by polyether amide (PEA) PELESTATT 6000 (trade name) available from Kureha Kagaku Kogyo. A 110 μm thick hollow cylindrical substrate was produced by the same procedure as in Substrate—Method 1. The surface resistivity of the substrate was measured to be $4.8\times10^{8}$ Ω/∞ on both sides thereof.

Substrate—Method 4

The mixture used in Substrate—Method 3 was also used except that the amount of organic conducting agent was 30 parts. A 150 μm thick hollow cylindrical substrate was produced by the same procedure as in Method 1. The surface resistivity of the substrate was measured to be $7.0\times10^{11}$ Ω/∞.

Examples of the method of producing the paint constituting the surface layer of the medium 12 are as follows.

Paint—Method 1

40 parts of fluorine-contained resin LUMIFLON LF200C (trade Name) available from Asahi Glass (Japan), 60 parts of conductive tin oxide T-1 available from Mitsubishi Material, and 150 parts of toluene/xylene=1/1 were used as a binder resin, conductive inorganic grain, and dispersant, respectively. The mixture of these substances was subjected to wet dispersion for 60 hours in a ball mill to produce a paint. An isocyanate-based hardener was added to 50 parts of the above paint, diluted by 50 parts of solvent having the above dispersant composition, sprayed onto the surface of a Teflon sheet, and then hardened under preselected conditions. The resulting film was separated from the Teflon sheet in order to measure its surface resistance. The surface resistance was $3.7\times10^{10}$ Ω/∞ on both sides of the film. The film was measured to be 15 μm thick.

Paint Method 2

The mixture used in Paint—Method 1 was also used except that the amount of binder resin and that of conductive inorganic gain were 30 parts and 70 parts, respectively. The mixture was subjected to the same procedure as in Paint—Method 1 to form a film on a Teflon sheet. The film separated from the Teflon sheet was measured to have a surface resistivity of $4.0\times10^{7}$ Ω/∞, and a thickness of 15 μm.

Paint Method 3

10 parts of binder resin used in Paint—Method 1, 2 parts of isocyanate-based hardener, and 100 parts of solvent implemented by toluene/xylene=1/1 were mixed, sprayed onto a Teflon sheet, and then hardened under preselected conditions. The resulting film was separated from the Teflon sheet and measured to have a surface resistivity of higher than $10^{13}$ Ω/∞ and a thickness of 15 μm.

Examples of the present invention and comparative examples will be described hereinafter.

EXAMPLES 1–7

The surface layers or paints produced by Paint—Methods 1–3 were sprayed onto the substrates produced by Substrate—Methods 1–4 in combinations shown in Examples 1–7 listed in Table 1 shown below, thereby producing intermediate image transfer media (belts).

Table 3 lists the surface resistances of the rears of the above media. The individual belt was mounted to a commercially available full-color copier PRETER 550 (trade name) available from Ricoh (Japan) and evaluated as to the scattering of toner and adverse effect by eye. The results of evaluation are also listed in Table 3.

EXAMPLES 8–11

In Examples 8–11, sheets of necessary size were cut away from the substrates produced by Substrate—Methods 1 and 3 to prepare substrate sheets. The substrate sheets were combined with insulative substrate sheets produced by molding only polyvinylidene fluoride by a heat press, in combinations shown in Table 2 shown below. The combined sheets were fused together by a heat press at 200° C. for 10 seconds at 15 kg/cm$^2$, cooled, and then cut off in a size of 10 cm×10 cm to produce an intermediate transfer medium (sheet).

The above media each had a particular surface resistance on the rear, as listed in Table 3. Subsequently, each media was fitted in a portion of the belt cut out beforehand, connected to the belt by an adhesive tape, mounted to the copier PRETER 550, and then evaluated as to the scattering of toner and adverse effect by eye in the same manner as in Examples 1–7. The results of evaluation are also listed in Table 3.

EXAMPLE 12

A sheet was cut away from the substrate produced by Substrate—Method 2 in a size of 10 cm×10 cm. On side of the sheet was subjected to corona discharge for 1 minute at 10 kV in order to lower its surface resistance. The sheet or medium had the processed side on its rear. The rear of the medium was measured to have a surface resistivity shown in Table 3. Subsequently, the medium was fitted in a portion of the belt cut out beforehand, connected to the belt by an adhesive tape, mounted to the copier PRETER 550, and then evaluated as to the scattering of toner and adverse effect by eye as in Examples 1–7. The result of evaluation is shown in Table 3.

COMPARATIVE EXAMPLES 1–11

The surface layers or paints produced by Paint—Methods were sprayed onto the substrates produced by Substrate—Methods in combinations listed in Examples 1–11 of Table 1 (no surface layers in Examples 1–4), thereby producing intermediate transfer media (belts).

The above media each had surface resistivities listed in Table 3 on their fronts and rears. Subsequently, each media or belt was mounted to the copier PRETER 550 and evaluated as to the scattering of toner and adverse effect by eye as in Examples 1–7. The results of evaluation are shown in Table 3.

TABLE 1

| | Substrate | Paint on Front | Paint on Rear |
|---|---|---|---|
| Ex. 1 | Substrate - Method 1 | Paint - Method 1 | — |
| Ex. 2 | Substrate - Method 1 | Paint - Method 3 | — |
| Ex. 3 | Substrate - Method 2 | — | Paint - Method 2 |
| Ex. 4 | Substrate - Method 2 | Paint - Method 1 | Paint - Method 2 |
| Ex. 5 | Substrate - Method 3 | Paint - Method 1 | — |
| Ex. 6 | Substrate - Method 3 | Paint - Method 3 | — |
| Ex. 7 | Substrate - Method 4 | Paint - Method 1 | Paint - Method 2 |
| Comp. Ex. 1 | Substrate - Method 1 | — | — |
| Comp. Ex. 2 | Substrate - Method 2 | — | — |
| Comp. Ex. 3 | Substrate - Method 3 | — | — |
| Comp. Ex. 4 | Substrate - Method 4 | — | — |
| Comp. Ex. 5 | Substrate - Method 1 | Paint - Method 2 | — |
| Comp. Ex. 6 | Substrate - Method 1 | — | Paint - Method 1 |
| Comp. Ex. 7 | Substrate Method 2 | Paint - Method 2 | Paint - Method 2 |
| Comp. Ex. 8 | Substrate - Method 3 | Paint - Method 2 | — |
| Comp. Ex. 9 | Substrate - Method 3 | — | Paint - Method 1 |
| Comp. Ex. 10 | Substrate - Method 4 | Paint - Method 2 | Paint - Method 2 |
| Comp. Ex. 11 | Substrate - Method 1 | — | Paint - Method 3 |

In Table 1, "-" shows that no surface layers are present.

TABLE 2

| | Front Substrate | Rear Substrate |
|---|---|---|
| Ex. 8. | insulative substrate | Substrate - Method 1 |
| Ex. 9 | insulative substrate | Substrate - Method 3 |
| Ex. 10 | Substrate - Method 2 | Substrate - Method 1 |
| Ex. 11 | Substrate - Method 4 | Substrate - Method 3 |

TABLE 3

| | Surface Resistivity | | Toner | Other |
|---|---|---|---|---|
| | Front | Rear | Scattering | Defects |
| Ex. 1 | $1.7 \times 10^{10}$ | $2.6 \times 10^{9}$ | ○ | none |
| Ex. 2 | above $10^{13}$ inclusive | $2.8 \times 10^{9}$ | ⊙ | some residual image |
| Ex. 3 | $1.8 \times 10^{11}$ | $6.4 \times 10^{7}$ | ⊙ | none |
| Ex. 4 | $4.0 \times 10^{10}$ | $6.5 \times 10^{7}$ | ⊙ | none |
| Ex. 5 | $3.5 \times 10^{10}$ | $4.8 \times 10^{8}$ | ○ | none |
| Ex. 6 | above $10^{13}$ inclusive | $5.0 \times 10^{8}$ | ⊙ | some residual image |
| Ex. 7 | $6.4 \times 10^{10}$ | $8.2 \times 10^{7}$ | ⊙ | none |
| Ex. 8 | above $10^{13}$ inclusive | $3.3 \times 10^{9}$ | ⊙ | some residual image |

TABLE 3-continued

| | Surface Resistivity | | Toner | Other |
|---|---|---|---|---|
| | Front | Rear | Scattering | Defects |
| Ex. 9 | above $10^{13}$ inclusive | $4.9 \times 10^{8}$ | ◎ | some residual image |
| Ex. 10 | $9.3 \times 10^{10}$ | $5.2 \times 10^{9}$ | ○ | none |
| Ex. 11 | $3.2 \times 10^{11}$ | $7.0 \times 10^{8}$ | ◎ | none |
| Ex. 12 | $1.5 \times 10^{11}$ | $2.2 \times 10^{9}$ | ○ | none |
| Comp. Ex. 1 | $2.5 \times 10^{9}$ | $2.5 \times 10^{9}$ | Δ | none |
| Comp. Ex. 2 | $1.8 \times 10^{11}$ | $1.8 \times 10^{11}$ | Δ | short image density |
| Comp. Ex. 3 | $4.8 \times 10^{8}$ | $4.8 \times 10^{8}$ | Δ | none |
| Comp. Ex. 4 | $7.0 \times 10^{11}$ | $7.0 \times 10^{11}$ | Δ | short image density |
| Comp. Ex. 5 | $4.5 \times 10^{7}$ | $2.4 \times 10^{9}$ | X | none |
| Comp. Ex. 6 | $2.8 \times 10^{9}$ | $3.3 \times 10^{10}$ | Δ | none |
| Comp. Ex. 7 | $4.7 \times 10^{7}$ | $4.7 \times 10^{7}$ | Δ | none |
| Comp. Ex. 8 | $4.4 \times 10^{7}$ | $4.8 \times 10^{8}$ | X | none |
| Comp. Ex. 9 | $4.9 \times 10^{8}$ | $4.1 \times 10^{10}$ | Δ | short image density |
| Comp. Ex. 10 | $6.0 \times 10^{7}$ | $6.0 \times 10^{7}$ | X | none |
| Comp. Ex. 11 | $3.2 \times 10^{9}$ | above $10^{13}$ inclusive | X | short image density |

In Table 3, a double circle, circle, triangle and cross respectively indicate no toner particles, less than ten toner particles, ten to hundred toner toner particles, and more than hundred toner particles. The double circuit and circle are representative of an acceptable level.

To evaluate the scattering of toner (Table 3), the belts produced by Examples 1–12 and Comparative Examples 1–11 were each mounted to the copier PRETER 550. A 1-dot black line was output on each belt and observed through a microscope VH-5910 (trade name) available from Keyence having a x200 lens (VH-200). Toner particles scattered around the line was counted.

As Table 3 indicates, Examples 1–12 remain in the allowable level as to the number of particles scattered around and are free from adverse effects. By contrast, Comparative Examples 1–11 are undesirable as to the scattering of toner.

In summary, in accordance with the present invention, an intermediate transfer medium has a lower surface resistivity on its rear than on its front or image support surface. Hence, a current path can be surely formed between a transfer bias applying member and a grounding member, and discharge from the image support surface of the medium to an image carrier, or vice versa, is reduced. As a result, a toner image formed on the image carrier is free from extraneous electrostatic forces other than a potential necessary for image transfer. This allows the toner image to be surely transferred from the image carrier to the medium.

Hence, as Examples and Comparative Examples clearly show, the medium of the present invention allows a sharp image free from the scattering of toner to be formed without any adverse effects. In addition, the present invention eliminates the need for a discharging mechanism and other extra mechanisms which are undesirable from the energy and cost standpoint.

Various modifications will become possible for those skilled in the art after receiving the teachings of the present disclosure without departing from the scope thereof.

What is claimed is:

1. In an intermediate transfer medium for an image forming apparatus which repeats with each of a plurality of toner images of particular colors a primary transfer for electrostatically transferring a toner image from an image carrier to a surface of said intermediate transfer medium, which is running at substantially a same speed as said image carrier, on the basis of a difference between a potential of said image carrier and a potential resulting from a voltage applied to between a transfer bias applying member and a grounding member located at a rear of said intermediate transfer medium, and then executes a secondary transfer for collectively transferring a composite image formed on said intermediate transfer medium by said primary transfer to a recording medium, said intermediate transfer medium has a lower surface resistivity on a rear thereof than on a front thereof constituting an image support surface.

2. An intermediate transfer medium as claimed in claim 1, wherein a portion of said intermediate transfer medium including said rear contains at least inorganic conductive grain, and wherein the surface resistivity of said rear is lower than $10^{11}$ Ω/∞ inclusive where ∞ is a unit area.

3. An intermediate transfer medium as claimed in claim 2, wherein the surface resistivity of said front is $10^{8}$ Ω/∞ to $10^{13}$ Ω/∞.

4. An intermediate transfer member as claimed in claim 1, wherein a portion of said intermediate transfer member including said rear contains at least inorganic conductive grain, and wherein the surface resistivity of said rear is lower than $10^{9}$ Ω/∞ inclusive.

5. An intermediate transfer member as claimed in claim 1, wherein the surface resistivity of said front is $10^{8}$ Ω/∞ to $10^{13}$ Ω/∞.

6. An intermediate transfer member as claimed in claim 1, wherein said intermediate transfer member comprises a seamless belt whose inner surface constitutes said rear.

7. An intermediate transfer member as claimed in claim 1, wherein said intermediate transfer medium comprises at least two layers.

8. In an image forming apparatus which repeats with each of a plurality of toner images of particular colors a primary transfer for electrostatically transferring a toner image from an image carrier to a surface of an intermediate transfer medium, which is running at substantially a same speed as said image carrier, on the basis of a difference between a potential of said image carrier and a potential resulting from a voltage applied to between a transfer bias applying member and a grounding member located at a rear of said intermediate transfer medium, and then executes a secondary transfer for collectively transferring a composite image formed on said intermediate transfer medium by said primary transfer to a recording medium, said intermediate transfer medium has a lower surface resistance on a rear thereof than on a front thereof constituting an image support surface.

* * * * *